US008388033B2

(12) United States Patent
Plair

(10) Patent No.: US 8,388,033 B2
(45) Date of Patent: Mar. 5, 2013

(54) METHOD AND APPARATUS FOR HOISTING OBJECTS USING A MODULAR LIFTING BEAM

(75) Inventor: James R. Plair, Dickinson, TX (US)

(73) Assignee: Alltec Lifting Systems LLC, Dickinson, TX (US)

( * ) Notice: Subject to any disclaimer, the term of this patent is extended or adjusted under 35 U.S.C. 154(b) by 182 days.

(21) Appl. No.: 12/952,888

(22) Filed: Nov. 23, 2010

(65) Prior Publication Data

US 2011/0140469 A1 Jun. 16, 2011

Related U.S. Application Data

(60) Provisional application No. 61/264,132, filed on Nov. 24, 2009.

(51) Int. Cl.
*B66C 1/00* (2006.01)

(52) U.S. Cl. ..... 294/81.3

(58) Field of Classification Search ..... 294/81.2, 294/81.3, 81.54, 81.1, 81.5, 81.62, 81.4
See application file for complete search history.

(56) References Cited

U.S. PATENT DOCUMENTS

| | | | | |
|---|---|---|---|---|
| 4,010,971 | A * | 3/1977 | Kuwamoto et al. | 294/81.2 |
| 4,035,010 | A * | 7/1977 | Kawashita et al. | 294/81.62 |
| 4,114,765 | A * | 9/1978 | Kojima | 414/756 |
| 4,128,267 | A | 12/1978 | Niblett et al. | |
| 4,240,660 | A * | 12/1980 | Roth et al. | 294/81.2 |
| 5,820,184 | A * | 10/1998 | Echenay | 294/81.2 |
| 6,048,012 | A | 4/2000 | Selby et al. | |
| 7,017,963 | B1 | 3/2006 | Setzke et al. | |
| 7,165,908 | B2 | 1/2007 | Liljedahl | |
| 7,478,852 | B1 | 1/2009 | Durden | |

* cited by examiner

*Primary Examiner* — Dean Kramer
*Assistant Examiner* — Stephen Vu
(74) *Attorney, Agent, or Firm* — Wong, Cabello, Lutsch, Rutherford & Brucculeri, L.L.P.

(57) ABSTRACT

A modular lifting beam comprises two, substantially vertical plates held in parallel, spaced-apart relation by one or more spacers. The modular lifting beam is equipped with a set of staggered mounting lugs at each end of the beam. The mounting lugs have holes passing from the upper surface to the lower surface and are configured such that two or more modular beams may be joined together in end-to-end fashion by inserting pins through their vertically-aligned lugs.

20 Claims, 7 Drawing Sheets

10
12
14
16
18
20
22
24
26
30
31
32
34
35
36
40
3B

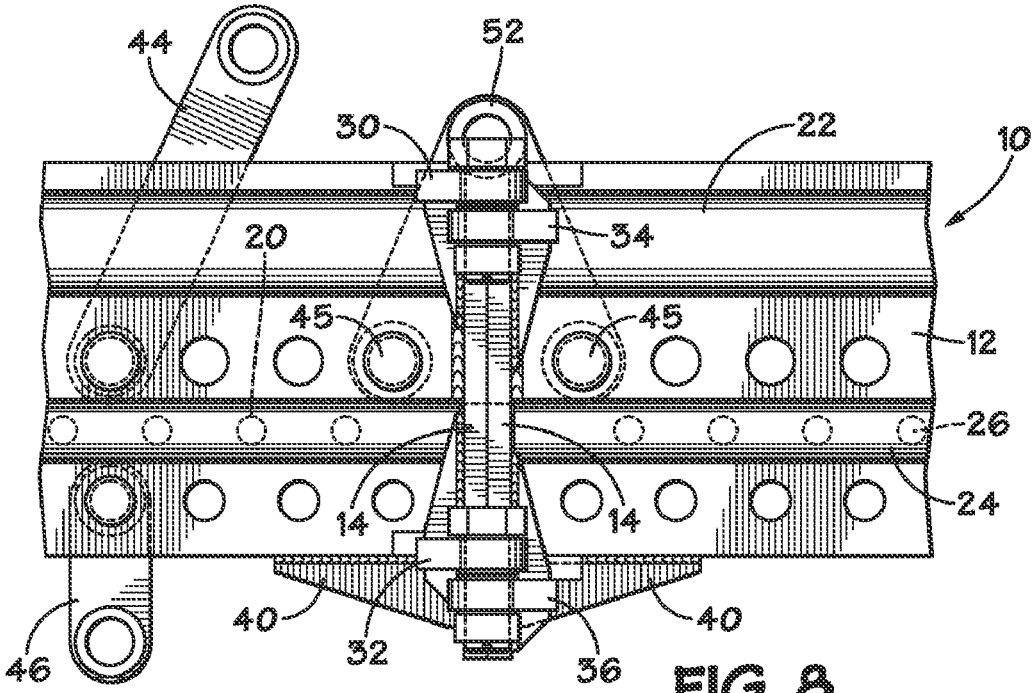
FIG. 8
FIG. 9
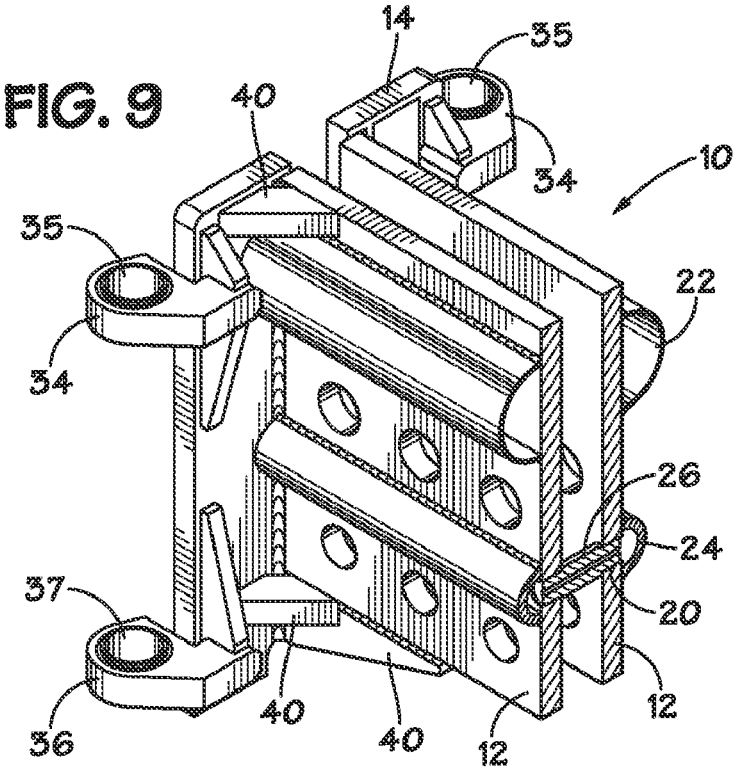
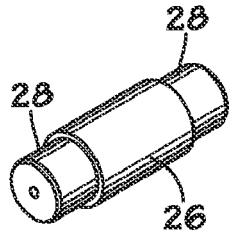
FIG. 10

METHOD AND APPARATUS FOR HOISTING OBJECTS USING A MODULAR LIFTING BEAM

CROSS-REFERENCE TO RELATED APPLICATIONS

This application claims the benefit of U.S. Provisional Application No. 61/264,132 filed Nov. 24, 2009.

STATEMENT REGARDING FEDERALLY SPONSORED RESEARCH OR DEVELOPMENT

Not Applicable

BACKGROUND OF THE INVENTION

1. Field of the Invention

This invention relates to rigging equipment. More particularly, it relates to lifting beams for use with hoists and cranes.

2. Description of the Related Art Including Information Disclosed Under 37 CFR 1.97 and 1.98

Lifting beams, spreader beams and truss beams are intended to balance and support a load by providing multiple lift points. Top and bottom flange stiffeners are added to strengthen the beam laterally in case of sideward movement caused by shifting of the load.

Lifting beams are often used in low headroom applications, and are structurally able to handle the load throughout the beam spread. Beams allow multiple point pick up of the load for balance or support purposes. Beams can be used from two hoists to increase lift capacity.

In a fixed hook lifting beam, a horizontal beam supports the load by spreading the lift points and transmits the vertical forces to the crane hook.

An adjustable hook lifting beam has multiple hook locations that allow the beam to accommodate a range of spreads. It is designed to have the capability of handling offset loads by placing hooks at asymmetric hole locations.

A twin bail lifting beam has two lift loops which increases lifting capabilities by making use of two hoists.

Lifting beams must often be custom fabricated for a particular lift that is to be performed. The modular lifting beam of the present invention permits a lifting beam to be assembled from modular components thereby increasing its versatility.

U.S. Pat. No. 7,478,852 describes a lifting apparatus which includes an I-beam having a lower flange and an upper flange; a plurality of hoist connectors positioned on the I-beam extending upwardly from the upper flange; a center load connector positioned on the I-beam extending downwardly from approximately a midpoint along the lower flange; and at least two movable load connectors positioned on the I-beam extending downwardly from the lower flange, each movable load connector engaged with the I-beam by a plurality of support members having one or more wheels positioned to roll along upper surfaces of the lower flange, the center load connector being positioned between the at least two movable load connectors. An associated method described in this patent includes providing the lifting apparatus; connecting a lifting machine to at least one of the hoist connectors; connecting a load to at least one of the load connectors; and lifting the load by using the lifting machine.

U.S. Pat. No. 7,165,908 describes an arrangement of telescoping lifting beams. Two telescopic lifting beams are loaded in their protruded position and are driven from a retracted position to a protruded position. In order to improve the bending strength of the lifting beams, the lifting beams are surrounded by two telescopic tubes, one of the tubes being fixed to the outer end of the telescopic first lifting beam and is slideable on the second telescopic tube, which extends inwardly on the second lifting beam.

U.S. Pat. No. 7,017,963 describes a counter-weighted lifting beam designed to lift and permit balancing of heavy loads. The lifting beam includes an internal counterweight that is adapted to be hydraulically adjusted by use of a manually operated control mechanism. The lifting beam also includes a rigid elongated lifting tower to add stability to the lifting beam and includes a centralized storage cabinet, which stores control mechanism and increases the weight concentration and the overall stability of the beam. Storage batteries and hydraulic control equipment are fully encased in the storage cabinet. As the lifting beam is held by the crane cable and a swivel, the beam can be moved in three dimensions.

U.S. Pat. No. 6,048,012 describes a self-leveling lifting beam adapted to be connected to the boom of crane to assist in the transport of a load to a high-rise building construction. The lifting beam works on the principle of an internal counterweight that is adapted to be hydraulically adjusted, and the use of electric limit switches to automatically maintain horizontal equilibrium even if a load shift occurs in mid-air. Storage batteries are encased in the apparatus to avoid the need for an attached electrical source. The lifting beam is held by the crane cable and a swivel such that the beam can be moved in all three dimensions.

U.S. Pat. No. 4,128,267 describes a lifting beam comprising an elongate member carrying one or more pivotally mounted hooks for engagement of a load to be lifted with a balance weight pivotably mounted on each hook to lie on either side of the pivotal axis thereof so as to cause the hook to be biased into or from engagement with the load such that selection of the position of the balance weight enables the beam automatically to pick up or release the load when the beam is lowered onto it.

BRIEF SUMMARY OF THE INVENTION

A lifting beam which comprises two, substantially vertical plates held in parallel, spaced-apart relation by one or more spacers is equipped with a set of staggered mounting lugs at each end of the beam. The mounting lugs are configured such that two or more such beams may be joined together in end-to-end fashion by inserting pins through holes in the vertically aligned lugs.

BRIEF DESCRIPTION OF THE SEVERAL VIEWS OF THE DRAWING(S)

FIG. 8 is a side view, partially in phantom of two, modular lifting beams according to the invention pinned together.

FIG. 9 is a partially cross-sectioned perspective view of one end of a modular lifting beam according to the invention.

FIG. 10 is a perspective view of a spacer used to join opposing plates of a lifting beam according to the invention.

DETAILED DESCRIPTION OF THE INVENTION

Figure 1:
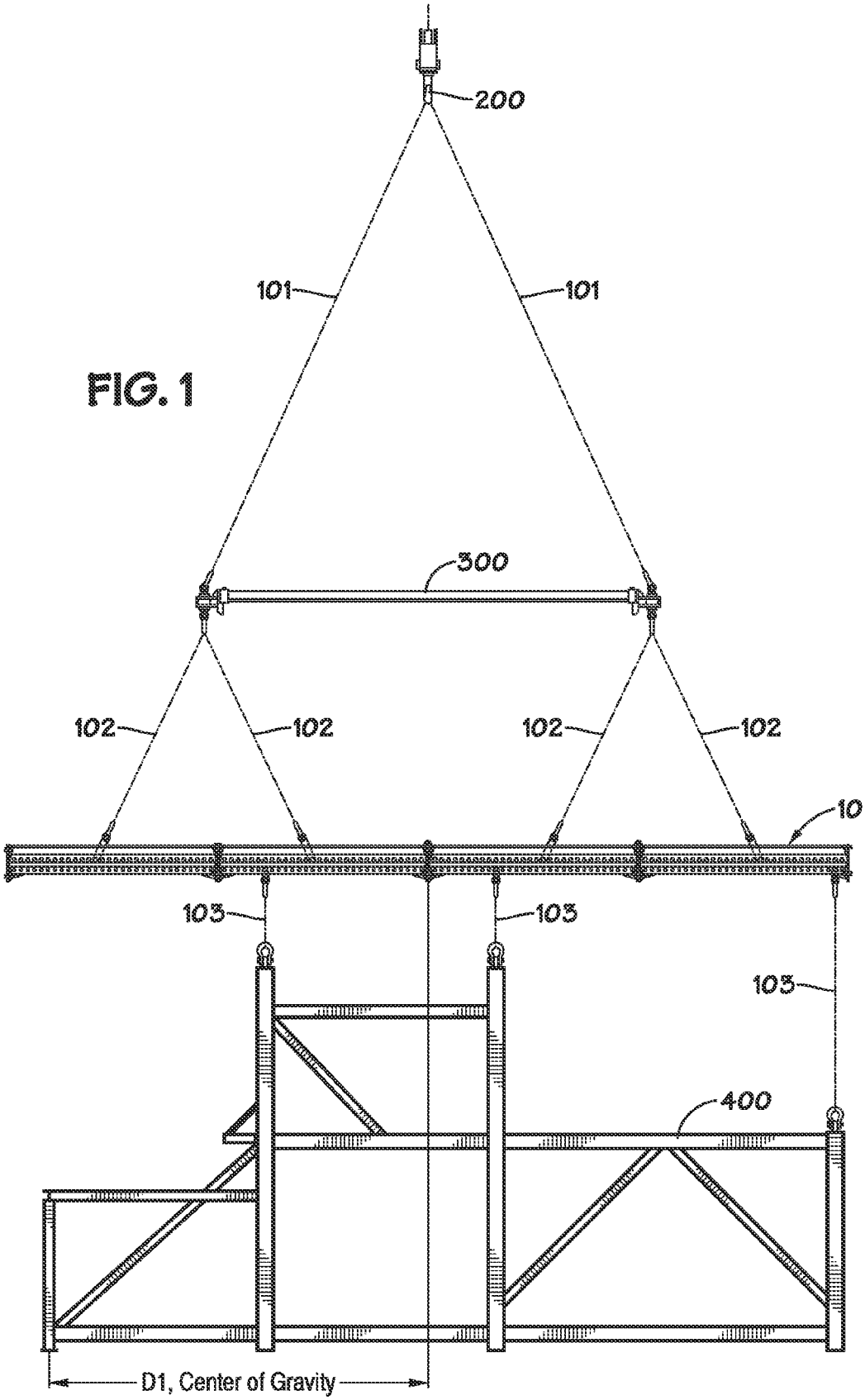
FIG. 1 is a side view of an equipment frame being lifted by a crane utilizing a pair of 4-module lifting beams according to one embodiment of the invention.

The invention may best be understood by reference to one particular preferred embodiment which is illustrated in the drawing figures.

Figure 2:
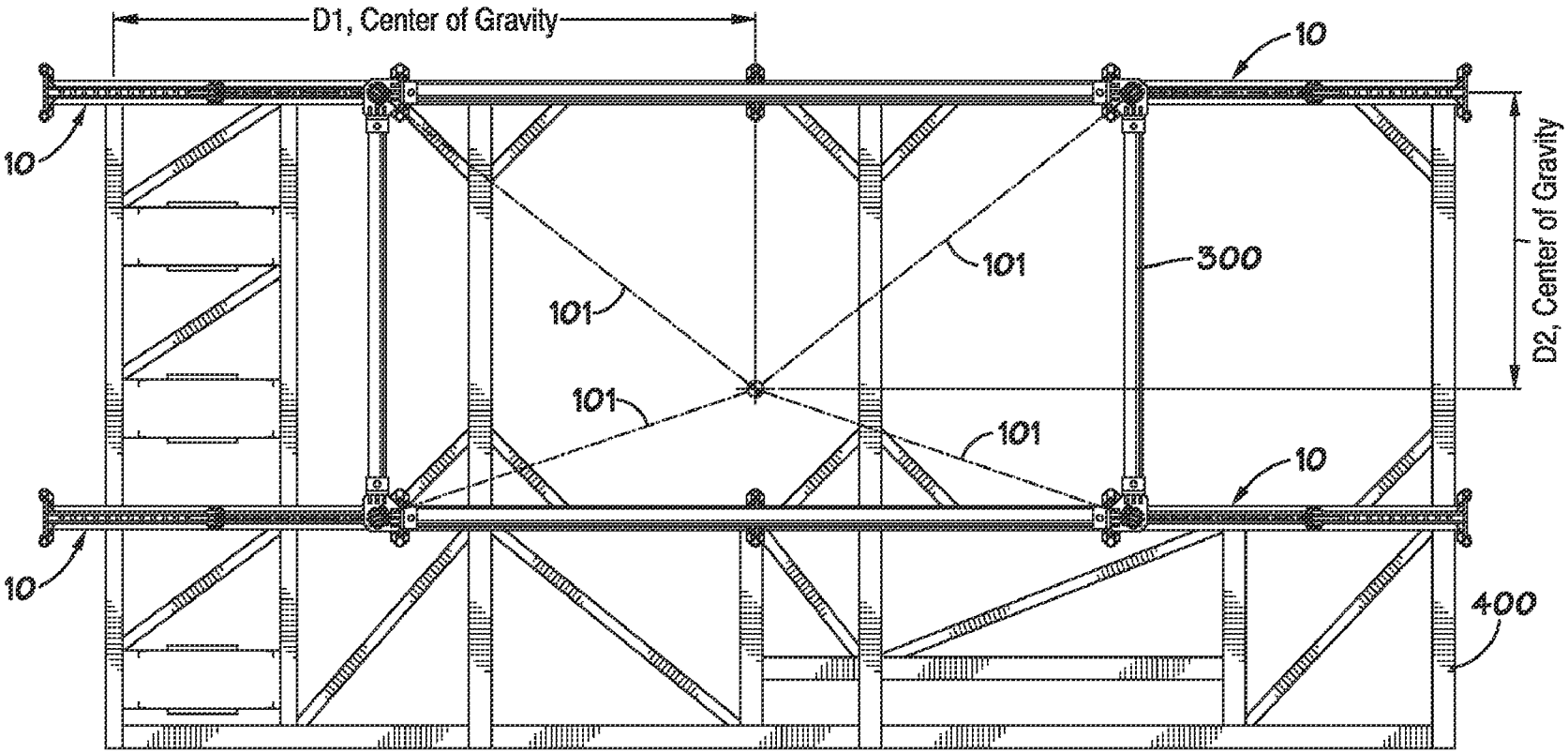
FIG. 2 is a top view of the rigging and equipment shown in FIG. 1.

A lift of frame-encased equipment 400 using a pair of lifting beams 10 according to the invention is illustrated in FIGS. 1 and 2. Equipment 400 is attached to lifting beam 10 by vertical cables 103. Lifting beam 10 is connected to the ends of spreader frame 300 by diagonal cables 102. Spreader frame 300 is attached to crane hook 200 by cables 101. The combination of lifting beam 10 and spreader frame 300 permits crane hook 200 to be positioned directly over the center of gravity (CG) of equipment 400. This permits the lift to be accomplished without tipping equipment 400.

Figures 3A, 3B, 3C, 3D:
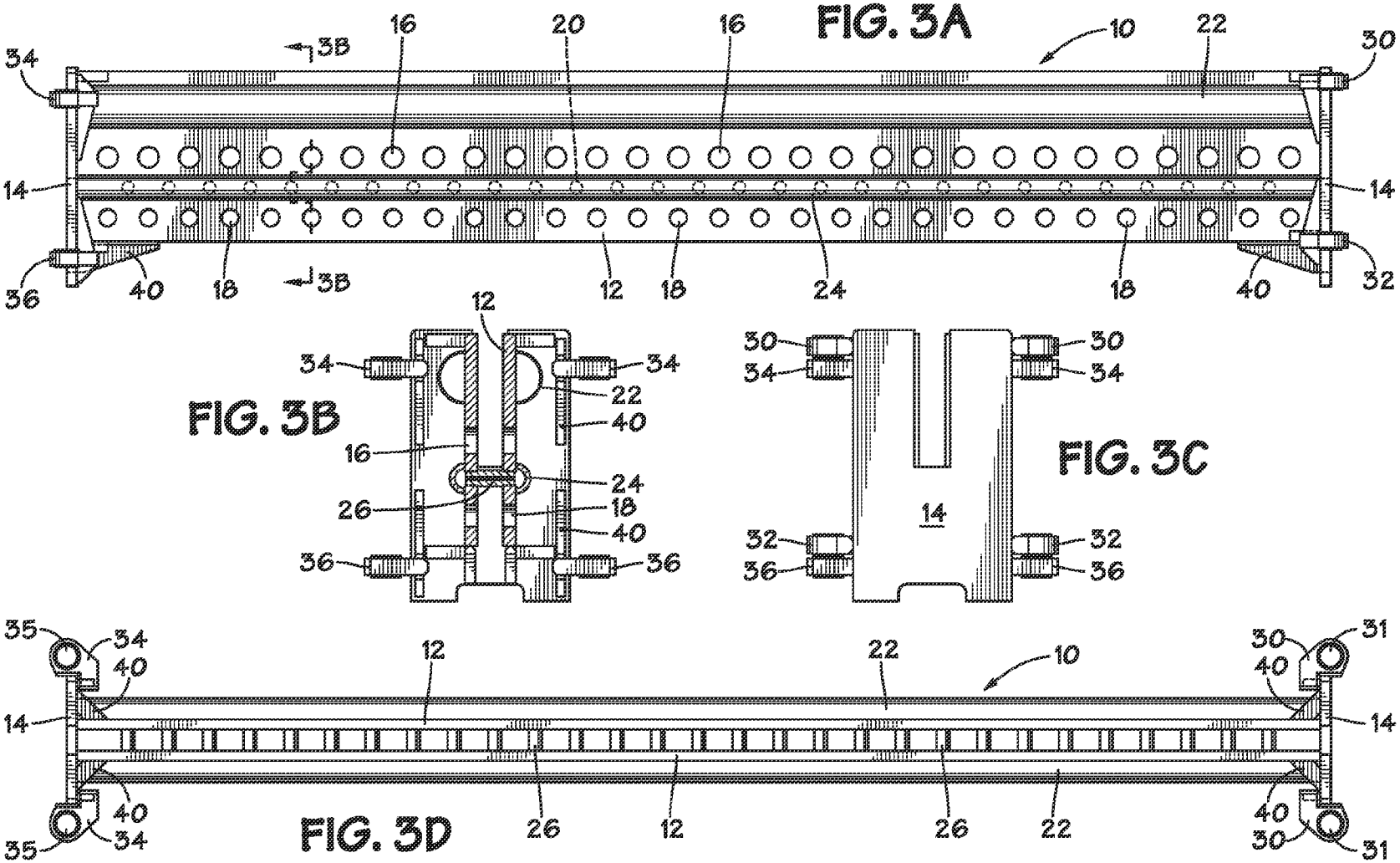
FIG. 3A is a side view of a modular lifting beam according to one embodiment of the invention.
FIG. 3B is a cross-sectional view taken along line 3B-3B in FIG. 3A.
FIG. 3C is an end view of the lifting beam illustrated in FIG. 3A.
FIG. 3D is a top view of the lifting beam illustrated in FIG. 3A.

The various views of FIG. 3 show a lifting beam 10 comprising two, substantially parallel plates 12 held in spaced-apart relation by end plates 14 and a plurality of spacers 26. Each plate 12 may have half-pipe longitudinal stiffener 22 welded or otherwise attached to its outer surface. Other means known in the art may be used to hold the parallel plates in spaced-apart relation. For example, a flanged beam may be used to connect the parallel plates.

Three, different linear arrays of holes are provided through each of plates 12—upper, larger holes 16; lower, smaller holes 18 and spacer holes 20. As may be seen in the cross-sectional views of FIG. 3B, spacers 26 may be inserted in holes 20 and secured to plates 12 by welding or other means. The exposed ends of spacers 26 may be covered by half-pipe longitudinal stiffener 24 on each side of lifting beam 10.

Mounting lugs 30, 32, 34 and 36 may be provided in pairs and may be attached to end plates 14. Reinforcing gusset plates 40 may be added to increase the strength of the attachment of the mounting lugs to the lifting beam 10. In the illustrated embodiment, lugs 30 and 34 are proximate the top edge of beam 10 and lugs 32 and 36 are proximate the lower edge of beam 10. Lugs 30 are vertically displaced from lugs 34 and lugs 32 are vertically displaced from lugs 36. This permits the holes (31, 33, 35 and 37) to be vertically aligned and pinned together when two modular lifting beams 10 are joined in end-to-end fashion (as shown in FIG. 8).

Figure 4:
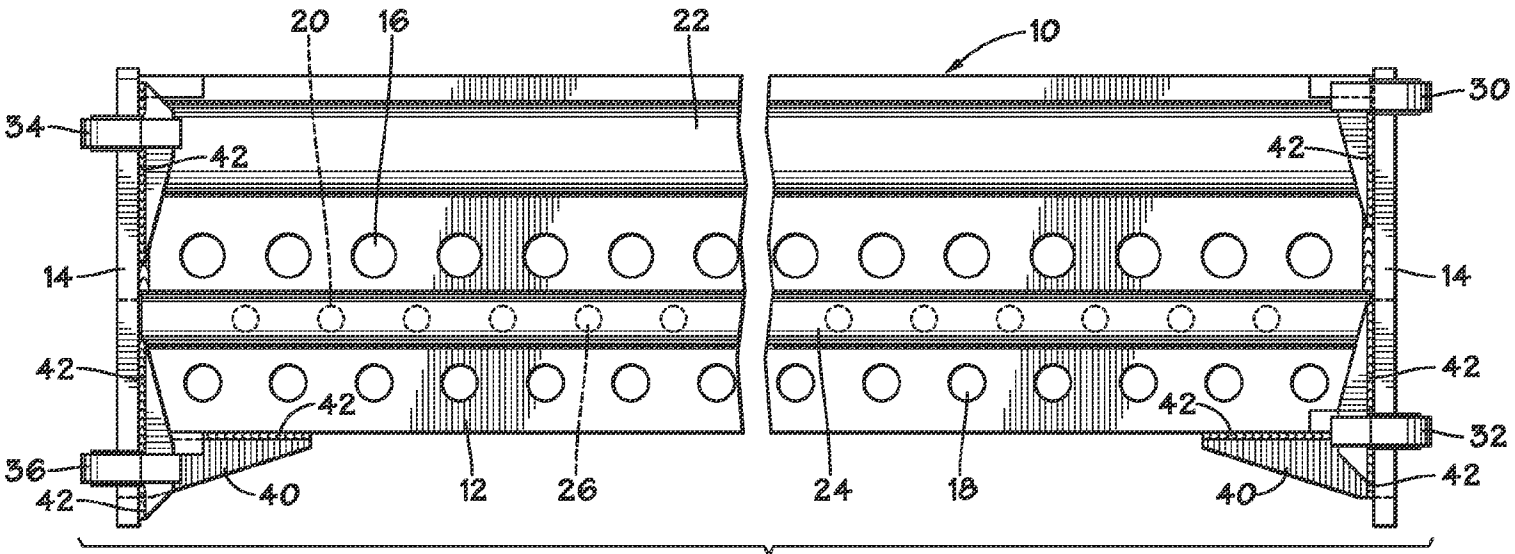
FIG. 4 is a side view fragmentary enlargement showing the weld seams of the lifting beam illustrated in FIG. 3.
Figure 5:
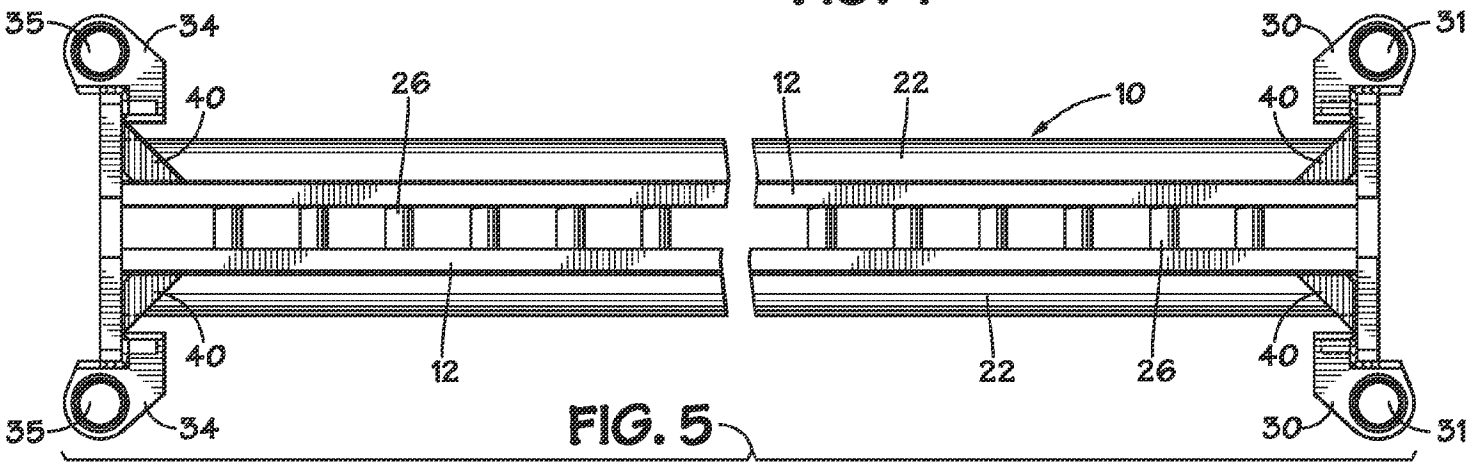
FIG. 5 is top view fragmentary enlargement of the lifting beam illustrated in FIG. 3.

The enlarged views of FIG. 4 and FIG. 5 show how gusset plates 40 may be affixed in position by welding at weld seams 42.

Figure 6:
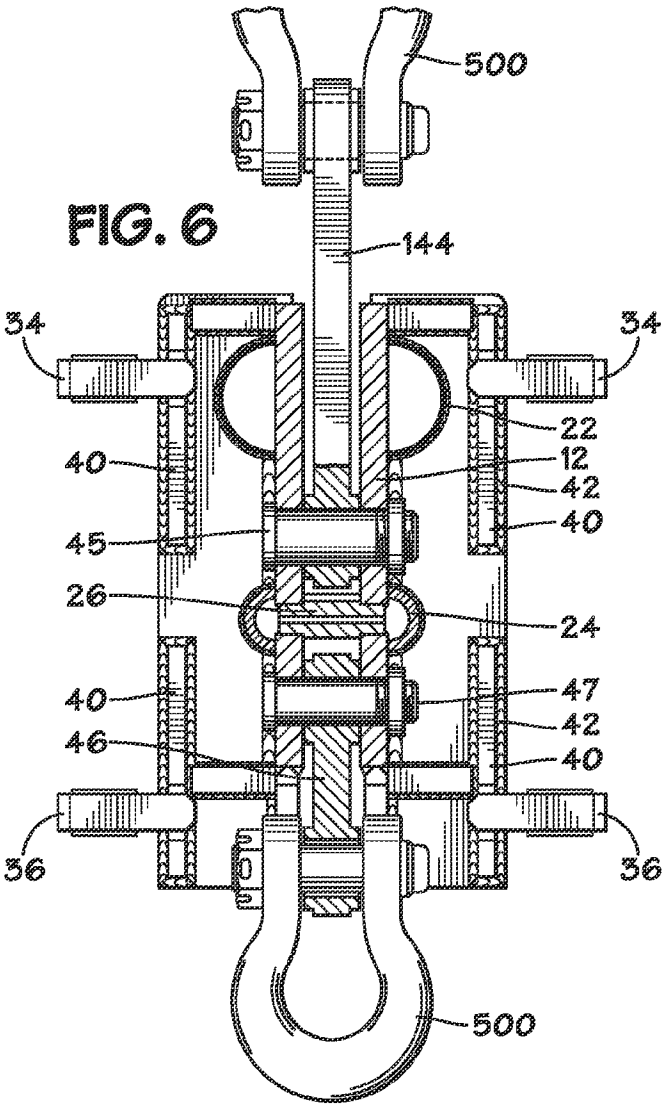
FIG. 6 is partially cross-sectioned view of a lifting beam according to the invention with shackles and connecting plates attached thereto.

The cross-sectional view of FIG. 6 shows how shackles may be attached to lifting beam 10. A shackle 500 may be attached to the upper side of beam 10 by upper link plate 44 which may be secured to beam 10 by pin 45 which engages a hole 16. Similarly, a shackle 500 may be attached to the lower side of beam 10 by lower link plate 46 which may be secured to beam 10 by pin 47 which engages a hole 18.

Figure 7:
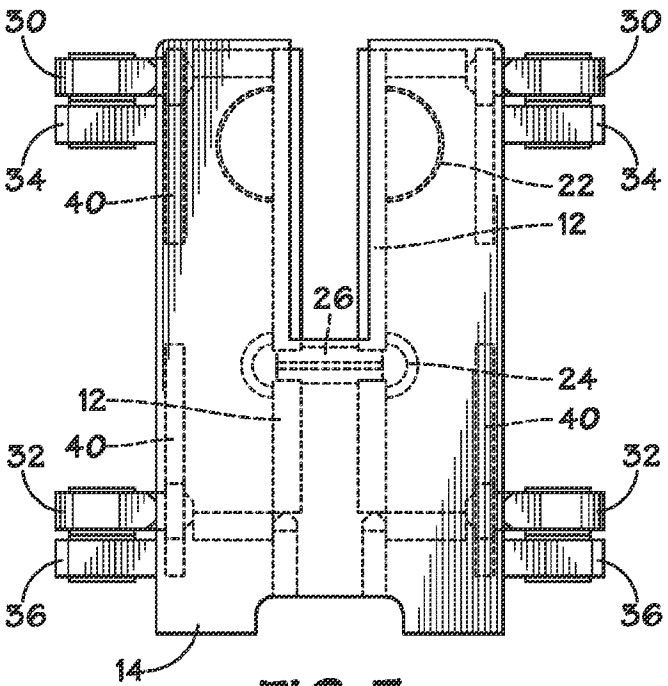
FIG. 7 is an end view, partially in phantom, of a modular lifting beam according to the invention.

FIG. 7 shows how the pair of higher mounting lugs (30,32) may align with the lower pair of mounting lugs (34,36) when two modular beams 10 are positioned in end-to-end relation. As may best be seen in FIG. 5, mounting lugs 30, 32, 34 and 36 may be sized and configured such that one-half of the diameter of holes 31, 33, 35 and 37 in the respective mounting lugs project past the terminus of end plate 14 of modular beam 10. In this way, the holes will align with those in a corresponding beam 10 when the beams are aligned end-to-end with their end plates 14 abutting one another.

FIG. 8 shows the joint between two modular beams 10 connected together. In addition to pins through the mounting lugs (30,32,34,36), the joint may include tri-plate 52 which engages both modules by pins 45 through holes 16. Tri-plate 52 also provides a hole directly above the joint between the two modular beams thereby providing yet another attachment point for a lifting cable.

FIG. 10 shows one, particular preferred spacer 26 fabricated from heavy-wall pipe stock. Areas of reduced diameter 28 may be provided to assist in maintaining a consistent, predetermined spacing between plates 12. The shoulders formed by sections 28 of reduced diameter may abut the inner face of plates 12 while the portion of reduced diameter 28 extends into and/or through hole 20. Spacers 26 may be welded in position. In certain embodiments, spacers 26 may be externally threaded and engage corresponding internal threads in holes 20. Other means of securing spacers 20 to plates 12 will be apparent to those skilled in the art.

Figure 11:
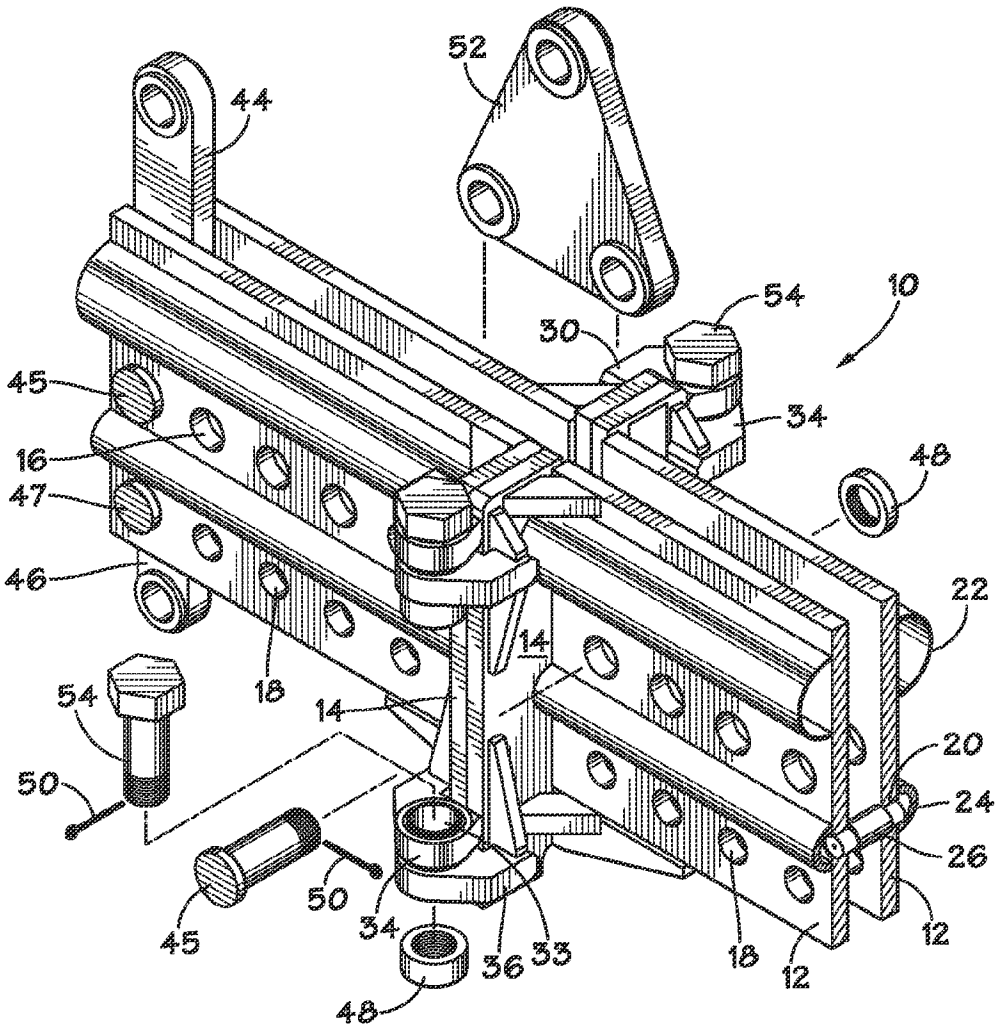
FIG. 11 is an exploded view of the joint between two modular lifting beams according to the invention.

The exploded view of FIG. 11 shows how two modular lifting beams 10 may be joined together. Pin 54 passes through hole 33 in lug 36 and may be secured by threaded keeper 48 and/or cotter pin 50. Additional pins 54 likewise secure lugs 30 and 34. Tri-plate 52 may be inserted in the space between plates 12 and secured by pins 45 through a pair of holes 16. Each pin 45 may be held in place by a threaded keeper 48 and/or cotter pin 50.

A lift using modular lifting beams as described above may be accomplished in the following manner. After determining the center of gravity (CG) of the object to be hoisted from above, a plurality of modular beams 10 are pinned together in end-to-end relationship to create a lifting beam of sufficient length to span the lifting points on the object. Optionally, a tri-plate (52) may be secured with pins (45) through endmost holes (16) in each beam module. Link plates (46) are secured with pins (47) in selected holes (18) of beam 10 such that substantially vertical cables (lines, chains, or the like) may be connected between the lifting points on the object and the lifting beam. Upper links plates (44) are secured with pins 45 at a first end thereof in selected holes 14 such that cables (lines, chains or the like) connected between a second end of each upper link plate and the hook of a hoist will result in the hook being substantially vertically aligned with the center of gravity of the object to be hoisted during the lift. Optionally, the cables connected to the second ends of the upper link plates may be run to a spreader (300) which is connected to the lifting hook.

As will be appreciated by those skilled in the art, if the object to be hoisted is has a center of gravity which is not in the same plane as its lifting points, it may be necessary to employ of plurality of lifting beams (together with appropriate spreaders) in order to position the lifting hook in substantial vertical alignment the object's CG. Such an arrangement comprising dual lifting beams and four spreaders is illustrated in FIGS. 1 and 2.

Although the invention has been described in detail with reference to certain preferred embodiments, variations and modifications exist within the scope and spirit of the invention as described and defined in the following claims.

What is claimed is:

1. A modular lifting beam comprising:

a first plate having a first end, an opposing second end, a top edge and an opposing bottom edge, and an inside surface and an outside surface;

a second plate in substantially parallel relation to said first plate and having a first end, an opposing second end, a top edge and an opposing bottom edge, and an inside surface and an outside surface;

a plurality of spacers, each of said spacers attached at a first end to the first plate and at an opposing second end to the second plate such that the first plate and the second plate are held in spaced-apart relation;

a first pair of upper lugs each having a hole extending from an upper surface of the lug to a lower surface thereof, at least one of said lugs attached to the first end of the first plate proximate the top edge of the first plate, said lug configured such that at least a portion of the hole extends beyond the first end of the first plate;

a first pair of lower lugs each having a hole extending from an upper surface of the lug to a lower surface thereof, at least one of said lugs attached to the first end of the first plate proximate the bottom edge of the first plate, said lug configured such that at least a portion of the hole extends beyond the first end of the first plate;

a second pair of upper lugs each having a hole extending from an upper surface of the lug to a lower surface thereof, at least one of said lugs attached to the second end of the first plate proximate the top edge of the first plate and vertically displaced from the first pair of upper lugs, said lug configured such that at least a portion of the hole extends beyond the second end of the first plate;

a second pair of lower lugs each having a hole extending from an upper surface of the lug to a lower surface thereof, at least one of said lugs attached to the second end of the first plate proximate the bottom edge of the first plate and vertically displaced from the first pair of lower lugs, said lug configured such that at least a portion of the hole extends beyond the second end of the first plate.

2. The modular lifting beam as recited in claim 1, wherein the hole in at least one of said lugs is a circular hole that extends one-half the diameter of the hole beyond the first end of the first plate.

3. The modular lifting beam as recited in claim 1, further comprising a pair of opposing end plates at least one of said end plates orthogonally attached to the first end of the first plate and the first end of the second plate.

4. The modular lifting beam as recited in claim 3, further comprising a substantially vertical notch in the upper edge of each end plate which extends to about the midpoint of the end plate having the notch therein.

5. The modular lifting beam as recited in claim 1, further comprising a stiffener attached to the outside surface of at least one of the first plate and the second plate.

6. The modular lifting beam as recited in claim 5, wherein the stiffener has a semicircular cross section.

7. The modular lifting beam as recited in claim 1, further comprising a linear array of holes through each of said parallel plates sized and spaced to receive the spacers.

8. The modular lifting beam as recited in claim 7, wherein the linear array of holes is parallel to the top and bottom edges of the parallel plates and the distance from the center of each of the holes to the bottom edge of the each of parallel plates is less than the distance from the center of each of the holes to the top edge of each of the parallel plates.

9. The modular lifting beam as recited in claim 8, wherein the spacers are welded to the holes.

10. The modular lifting beam as recited in claim 8, wherein the spacers comprise external threads which engage internal threads in the holes.

11. The modular lifting beam as recited in claim 7, wherein the spacers are substantially cylindrical in shape and have a section of reduced diameter at each end.

12. The modular lifting beam as recited in claim 11, wherein the section of reduced diameter has a length approximately equal to the thickness of the parallel plates.

13. The modular lifting beam as recited in claim 7, further comprising a cover having a semicircular cross section attached to the outside surface of at least one of the first plate and the second plate over the linear array of holes.

14. The modular lifting beam as recited in claim 1, further comprising a linear array of holes in the parallel plates parallel to the top edge of the plates and positioned between the top edge of each of said plates and the spacers.

15. The modular lifting beam as recited in claim 1, further comprising a linear array of holes in the parallel plates parallel to the bottom edge of the plates and positioned between the bottom edge of each of said plates and the spacers.

16. The modular lifting beam as recited in claim 1, further comprising a first linear array of holes in the parallel plates parallel to the top edge of the plates and positioned between the top edge of each of said plates and the spacers and a second linear array of holes in the parallel plates parallel to the bottom edge of the plates and positioned between the bottom edge of each of said plates and the spacers.

17. A method for hoisting an object from above comprising:

connecting together at least two modular lifting beams according to claim 1 by aligning the beams in end-to-end arrangement and inserting pins through the holes in the upper lugs and the lower lugs;

attaching a plurality of lines from an object to be hoisted to points on the lifting beams located below the spacers; and, attaching at least two lines from a hoist to points on the lifting beams located above the spacers.

18. A modular lifting beam comprising:

a first plate having a first end, an opposing second end, a top edge and an opposing bottom edge;

a second plate in substantially parallel relation to said first plate and haying a first end, an opposing second end, a top edge and an opposing bottom edge;

at least one spacer attached at a first end to the first plate and at an opposing second end to the second plate such that the first plate and the second plate are held in spaced-apart relation;

a pair of opposing end plates each of said end plates orthogonally attached to one of the first end and the second end of the first plate and one of the first end and the second end of the second plate;

a first pair of upper lugs each having a hole extending from an upper surface of the lug to a lower surface thereof, each of said lugs attached to one end plate at the first end of one of the first plate and second plate proximate the top edge of the plate to which said lug is attached, each of said lugs configured such that at least a portion of the hole extends beyond the end plate to which said lug is attached;

a first pair of lower lugs each of said lugs having a hole extending from an upper surface of the lug to a lower surface thereof, each of said lugs attached to one end plate at the first end of the first plate and the second plate proximate the bottom edge of the first plate, each of said lugs configured such that at least a portion of the hole extends beyond the end plate to which said lug is attached;

a second pair of upper lugs of said lugs each having a hole extending from an upper surface of the lug to a lower surface thereof, each of said lugs attached to one end plate at the second end of one of the first plate and the second plate proximate the top edge of the plate and vertically displaced from the first pair of upper lugs, each of said lugs configured such that at least a portion of the hole extends beyond the end plate to which said lug is attached;

a second pair of lower lugs each of said lugs having a hole extending from an upper surface of the lug to a lower surface thereof, each of said lugs attached to one end plate at the second end of the first plate and the second plate proximate the bottom edge of the plate and vertically displaced from the first pair of lower lugs, each of said lugs configured such that at least a portion of the hole extends beyond the end plate to which said lug is attached.

19. The modular lifting beam as recited in claim 18, further comprising a plurality of gusset plates each of said gusset plates attached at a first end thereof to an end plate and to an adjoining parallel plate at a second end thereof.

20. The modular lifting beam as recited in claim 18, further comprising a substantially rectangular notch in the upper edge of each end plate, the width of the notch being approximately equal to the spacing between the two parallel plates.

* * * * *